US005842967A

United States Patent [19]

Kroll

[11] Patent Number: 5,842,967

[45] Date of Patent: Dec. 1, 1998

[54] CONTACTLESS TRANSDUCER STIMULATION AND SENSING OF OSSICULAR CHAIN

[75] Inventor: Kai Kroll, Minnetonka, Minn.

[73] Assignee: St. Croix Medical, Inc., Minneapolis, Minn.

[21] Appl. No.: 693,454

[22] Filed: Aug. 7, 1996

[51] Int. Cl.[6] ..... H04R 25/00

[52] U.S. Cl. ..... 600/25; 607/55

[58] Field of Search ..... 623/10; 600/25; 607/55–57; 381/68, 68.3, 69; 181/128, 129

[56] References Cited

U.S. PATENT DOCUMENTS

| | | | |
|---|---|---|---|
| 3,557,775 | 1/1971 | Mahoney | 128/1 |
| 3,594,514 | 7/1971 | Wingrove . | |
| 3,712,962 | 1/1973 | Epley . | |
| 3,764,748 | 10/1973 | Branch et al. | 179/107 E |
| 3,931,648 | 1/1976 | Shea | 3/1.9 |
| 4,729,366 | 3/1988 | Schaefer et al. | 128/1.6 |
| 4,774,933 | 10/1988 | Hough et al. | 600/25 |
| 4,776,322 | 10/1988 | Hough et al. | 128/1.6 |
| 4,817,607 | 4/1989 | Tatge | 381/68 |
| 4,840,178 | 6/1989 | Heide et al. | 381/68.3 |
| 4,850,962 | 7/1989 | Schaefer | 600/25 |
| 4,957,478 | 9/1990 | Maniglia | 600/25 |
| 5,012,520 | 4/1991 | Steeger | 381/68 |
| 5,015,224 | 5/1991 | Maniglia | 600/25 |
| 5,015,225 | 5/1991 | Hough et al. | 600/25 |
| 5,163,957 | 11/1992 | Sadé et al. | 381/68.3 |
| 5,277,694 | 1/1994 | Leysieffer et al. | 600/25 |
| 5,282,858 | 2/1994 | Bisch et al. | 623/10 |
| 5,338,287 | 8/1994 | Miller et al. | 600/25 |
| 5,360,388 | 11/1994 | Spindel et al. | 600/25 |
| 5,411,467 | 5/1995 | Hortmann et al. | 600/25 |
| 5,456,654 | 10/1995 | Ball | 600/25 |
| 5,498,226 | 3/1996 | Lenkauskas | 600/25 |
| 5,531,787 | 7/1996 | Lesinski et al. | 623/10 |
| 5,554,096 | 9/1996 | Ball | 600/25 |
| 5,624,376 | 4/1997 | Ball | 600/25 |

OTHER PUBLICATIONS

"Middle Ear Implant: Implantable Hearing Aids", *Advances in Audiology, vol. 4, M. Hoke Series Editor*, Karger, 1–169, (1988).

T. Dumon, et al., "Piezoelectric Middle Ear Implant: Experimental Results", *Abstract of Paper Presented at International Symposium on Electronic Implants in Otology and Conventional Hearing Aids*, Walt Disney World Swan, Abstract #35, (Nov. 11–14, 1996).

J. M. Frederickson, et al., "Ongoing Investigations into an Implantable Electromagnetic Hearing Aid for Moderate to Severe Sensorineural Hearing Loss", *Otolaryngological Clinics of North America, vol. 28, No. 1*, 107–121, (Feb. 1995).

K. Gyo, et al., "Sound Pickup Utilizing an Implantable Piezpelectric Ceramic Bimorph Element: Application to the Cochlear Implant", *American Journal of Otology, vol. 5, No. 4*, 273–276, (Apr. 1984).

K. Gyo, et al., "Stapes Vibration Produced by the Output Transducer of an Implantable Hearing Aid", *Arch Otolaryngol Head Neck Surg., vol. 113*, 1078–1081, (Oct. 1987).

(List continued on next page.)

*Primary Examiner*—John P. Lacyk
*Assistant Examiner*—Rosiland Kearney
*Attorney, Agent, or Firm*—Patterson & Keough, P.A.

[57] ABSTRACT

An implantable hearing aid system for the middle ear utilizes pairs of permanent magnets to engage transducers with auditory elements in a middle ear. At least one transducer is supported within the middle ear cavity by a support. A transducer is magnetically-engaged with a malleus in one embodiment and another transducer is magnetically-engaged with a stapes in other embodiments. When using two contactless transducers, a permanent magnet is attached to each transducer. A permanent magnet is also attached to the malleus and to the stapes. The permanent magnet on each transducer is situated such that its polarity acts in repulsion to the permanent magnet on the adjacent auditory element.

8 Claims, 4 Drawing Sheets

OTHER PUBLICATIONS

G. Jako, "Biomedical Engineering in Ear Surgery", *Otolaryngological Clinics of North America, vol. 5, No. 1*, 173–182, (Feb. 1972).

Wen H. Ko, et al., "Engineering Principles of Mechanical Stimulation of the Middle Ear", *Otolaryngological Clinics of North America, vol. 28, No. 1*, 29–41 (Feb. 1995).

K. Kodera, et al., "Sound Evaluation of Partially Implantable Piezoelectric Middle Ear Implant: Comparative Study of Frequency Responses", *ENT Journal, vol. 73, No. 2*, 108–111, (Feb. 1994).

A. J. Maniglia, et al., "A Contactless Electromagnetic Implantable Middle Ear Device for Sensorineural Hearing Loss", *ENT Journal, vol. 73, No. 2*, 78–90, (Feb. 1994).

A. J. Maniglia, et al., "Contactless, Semi–Implantable Electromagnetic Hearing Device for the Treatment of Sensorineural Hearing Loss", *Abstract of Paper Presented at International Symposium on Electronic Implants in Otology and Conventional Hearing Aids*, Walt Disney World Swan, Abstract #29, (Nov. 11–14, 1993).

Jun–Ichi Suzuki, et al., "Long–Term Clinical Results of the Partially Implantable Piezoelectric Middle Ear Implant", *ENT Journal, vol. 73, No. 2*, 104–107, (Feb. 1994).

M. Tos, et al., "Implantation of Electromagnetic Ossicular Replacement Device", *ENT Journal, vol. 73, No. 2*, 93–103, (Feb. 1994).

D. B. Welling, et al., "Auditory Stimulation of the Inner Ear via the Semicircular Canals", *Abstract of paper presented at International Symposium on Electronic Implants in Otology and Conventional Hearing Aids*, Walt Disney World Swan, Abstract #9, (Nov. 11–14, 1993).

N. Yanagihara, et al., "Partially Implantable Hearing Aid using Piezoelectric Ceramic Ossicular Vibrator", *Abstract of Paper Presented at International Symposium on Electronic Impants in Otology and Conventional Hearing Aids*, Walt Disney World Swan, Abstract #26, (Nov. 11–14, 1993).

CONTACTLESS TRANSDUCER STIMULATION AND SENSING OF OSSICULAR CHAIN

FIELD OF THE INVENTION

This invention relates to mounting implantable hearing system transducers within the middle ear.

BACKGROUND

In an implantable hearing aid system, transducers within the middle ear engage an auditory element and transduce from electrical signals into mechanical vibrations, and vice versa. Middle ear hearing aid systems are not as susceptible to mechanical feedback as other types of systems. Such implantable hearing aid systems are more comfortable for the patient than other types of hearing aids, such as those placed directly in the external auditory canal.

Transducers which contact an auditory element, such as one of the elements of the ossicular chain, require reliable disposition within the middle ear. Some disposition methods mechanically affix transducers directly to elements of the ossicular chain, e.g. mechanical fasteners, such as screws; metal hooks or bands; a constant force alone; or adhesives mount the transducer to an auditory element. Each of these methods has associated problems with affixation. There is a need for improving the disposition of transducers in an implantable hearing aid system.

SUMMARY OF THE INVENTION

An implantable hearing system for the middle ear utilizes pairs of permanent magnets to engage transducers with auditory elements in a middle ear. The two transducers are supported within the middle ear cavity by a support. A transducer is magnetically-engaged with a malleus and another transducer is magnetically-engaged with a stapes. However, it is not necessary to support both sensing and stimulating transducers within the middle ear using this invention. This invention is particularly advantageous for supporting sensing transducers, but driving transducers could be supported as well.

A permanent magnet is attached to each transducer. A permanent magnet is also attached to the malleus and to the stapes. The permanent magnet on each transducer is situated such that its polarity acts in repulsion to the permanent magnet on the adjacent auditory element. Alternatively, an implantable hearing aid may use just one of the magnet-magnet devices. The other driver/sensor (input or output) may then use traditional attachment means. In further embodiments, each transducer is encased in a biocompatible transducer case. By encasing the transducer in a case, acoustic feedback is decreased as compared with non-encased transducers.

Preferably, the transducer is a piezoelectric transducer, which exhibits a higher efficiency than other types of transducers that can be used with the invention. After the transducer support and permanent magnets are implanted and physiologically adapted in the middle ear, a constant force is applied at all times.

DETAILED DESCRIPTION

Figure 1A:
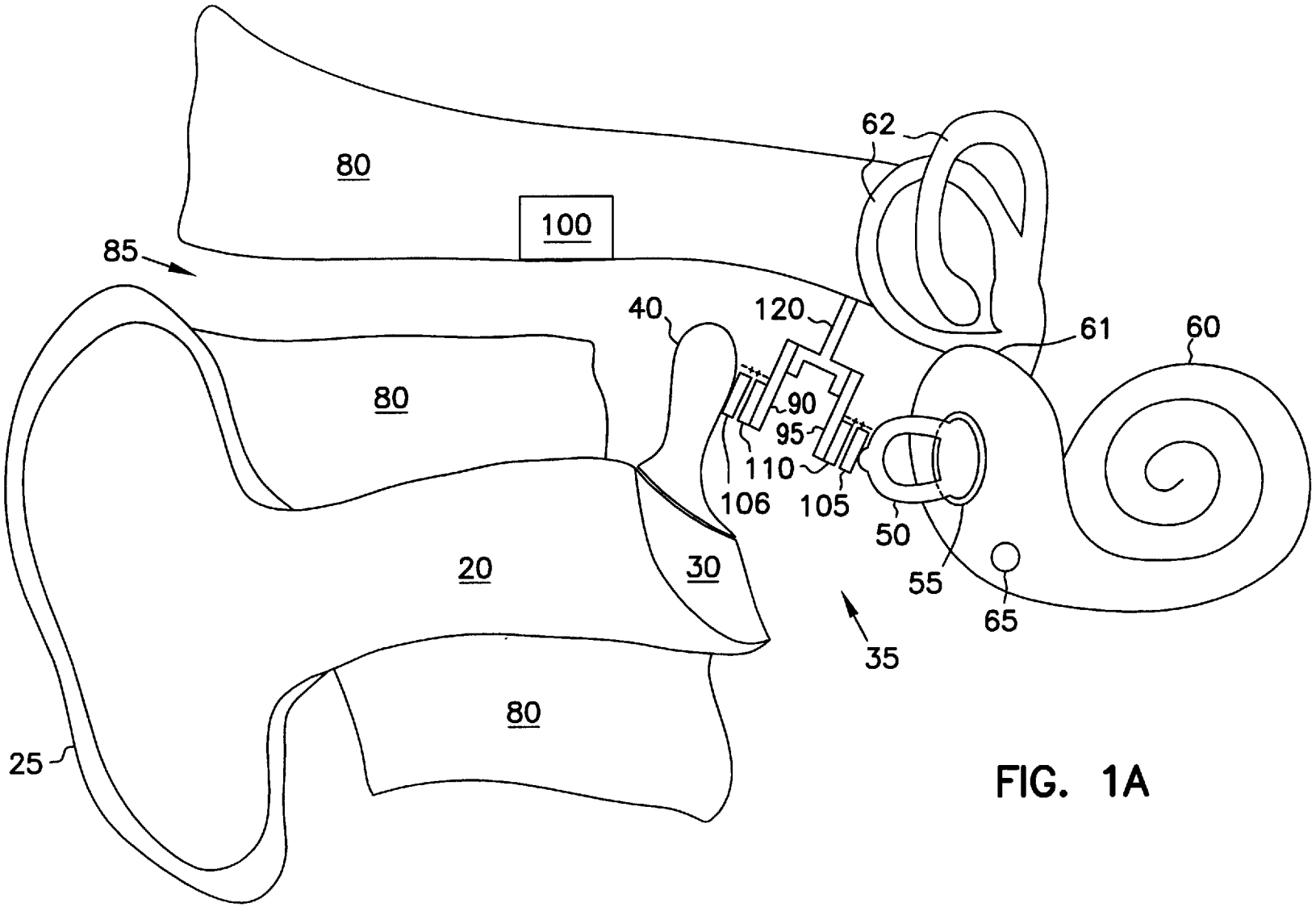
FIG. 1A is an illustration of a human auditory system, in which the invention is placed.

This invention provides a mount for engaging a transducer with an auditory element in the middle ear for use in an implantable hearing aid (IHA) system or other implantable hearing system, such as a cochlear implant with middle ear vibration sensing. The invention utilizes permanent magnets to engage the transducer with the auditory element. The invention is particularly applicable to both partial middle ear implantable (P-MEI) or total middle ear implantable (T-MEI) hearing aid systems. A P-MEI or T-MEI hearing aid system assists the human auditory system in converting acoustic energy contained within sound waves into electrochemical signals delivered to the brain and interpreted as sound. FIG. 1A illustrates generally the use of the invention in a human auditory system. Sound waves are directed into an external auditory canal 20 by an outer ear (pinna) 25. The frequency characteristics of the sound waves are slightly modified by the resonant characteristics of the external auditory canal 20. These sound waves impinge upon the tympanic membrane (eardrum) 30, interposed at the terminus of the external auditory canal, between it and the tympanic cavity (middle ear) 35. Variations in the sound waves produce tympanic vibrations. The mechanical energy of the tympanic vibrations is communicated to the inner ear, comprising cochlea 60, vestibule 61, and semicircular canals 62, by a sequence of articulating bones located in the middle ear 35. This sequence of articulating bones is referred to generally as the ossicular chain. Thus, the tympanic membrane 30 and ossicular chain transform acoustic energy in the external auditory canal 20 to mechanical energy at the cochlea 60.

The ossicular chain includes three primary components: a malleus 40, an incus (not shown), and a stapes 50. The malleus 40 includes manubrium and head portions. The manubrium of the malleus 40 attaches to the tympanic membrane 30. The head of the malleus 40 articulates with one end of the incus. The incus normally couples mechanical energy from the vibrating malleus 40 to the stapes 50. The stapes 50 includes a capitulum portion, comprising a head and a neck, connected to a footplate portion by means of a support crus comprising two crura. The stapes 50 is disposed in and against a membrane-covered opening on the cochlea 60. This membrane-covered opening between the cochlea 60 and middle ear 35 is referred to as the oval window 55. Oval window 55 is considered part of cochlea 60 in this patent application. The incus articulates the capitulum of the stapes 50 to complete the mechanical transmission path.

Normally, prior to implantation of the invention, tympanic vibrations are mechanically conducted through the malleus 40, incus, and stapes 50, to the oval window 55. Vibrations at the oval window 55 are conducted into the fluid-filled cochlea 60. These mechanical vibrations generate fluidic motion, thereby transmitting hydraulic energy within the cochlea 60. Pressures generated in the cochlea 60 by fluidic motion are accommodated by a second membrane-covered opening on the cochlea 60. This second membrane-covered opening between the cochlea 60 and middle ear 35 is referred to as the round window 65. Round window 65 is considered part of cochlea 60 in this patent application. Receptor cells in the cochlea 60 translate the fluidic motion into neural impulses which are transmitted to the brain and perceived as sound. However, various disorders of the tympanic membrane 30, ossicular chain, and/or cochlea 60 can disrupt or impair normal hearing.

Hearing loss due to damage in the cochlea is referred to as sensorineural hearing loss. Hearing loss due to an inability to conduct mechanical vibrations through the middle ear is referred to as conductive hearing loss. Some patients have an ossicular chain lacking sufficient resiliency to transmit mechanical vibrations between the tympanic membrane 30 and the oval window 55. As a result, fluidic motion in the cochlea 60 is attenuated. Thus, receptor cells in the cochlea 60 do not receive adequate mechanical stimulation. Damaged elements of ossicular chain may also interrupt transmission of mechanical vibrations between the tympanic membrane 30 and the oval window 55.

Various techniques have been developed to remedy hearing loss resulting from conductive or sensorineural hearing disorder. For example, tympanoplasty is used to surgically reconstruct the tympanic membrane 30 and establish ossicular continuity from the tympanic membrane 30 to the oval window 55. Various passive mechanical prostheses and implantation techniques have been developed in connection with reconstructive surgery of the middle ear 35 for patients with damaged ossicles. Two basic forms of prosthesis are available: total ossicular replacement prostheses (TORP), which is connected between the tympanic membrane 30 and the oval window 55; and partial ossicular replacement prostheses (PORP), which is positioned between the tympanic membrane 30 and the stapes 50.

Various types of hearing aids have been developed to compensate for hearing disorders. A conventional "air conduction" hearing aid is sometimes used to overcome hearing loss due to sensorineural cochlear damage or mild conductive impediments to the ossicular chain. Conventional hearing aids utilize a microphone, which transduces sound into an electrical signal. Amplification circuitry amplifies the electrical signal. A speaker transduces the amplified electrical signal into acoustic energy transmitted to the tympanic membrane 30. However, some of the transmitted acoustic energy is typically detected by the microphone, resulting in a feedback signal which degrades sound quality. Conventional hearing aids also often suffer from a significant amount of signal distortion.

Implantable hearing aid systems have also been developed, utilizing various approaches to compensate for hearing disorders. For example, cochlear implant techniques implement an inner ear hearing aid system. Cochlear implants electrically stimulate auditory nerve fibers within the cochlea 60. A typical cochlear implant system includes an external microphone, an external signal processor, and an external transmitter, as well as an implanted receiver and an implanted single channel or multichannel probe. A single channel probe has one electrode. A multichannel probe has an array of several electrodes. In the more advanced multichannel cochlear implant, a signal processor converts speech signals transduced by the microphone into a series of sequential electrical pulses of different frequency bands within a speech frequency spectrum. Electrical pulses corresponding to low frequency sounds are delivered to electrodes that are more apical in the cochlea 60. Electrical pulses corresponding to high frequency sounds are delivered to electrodes that are more basal in the cochlea 60. The nerve fibers stimulated by the electrodes of the cochlear implant probe transmit neural impulses to the brain, where these neural impulses are interpreted as sound.

Other inner ear hearing aid systems have been developed to aid patients without an intact tympanic membrane 30, upon which "air conduction" hearing aids depend. For example, temporal bone conduction hearing aid systems produce mechanical vibrations that are coupled to the cochlea 60 via a temporal bone in the skull. In such temporal bone conduction hearing aid systems, a vibrating element can be implemented percutaneously or subcutaneously.

A particularly interesting class of hearing aid systems includes those which are configured for disposition principally within the middle ear 35 space. In middle ear implantable (MEI) hearing aids, an electrical-to-mechanical output transducer couples mechanical vibrations to the ossicular chain, which is optionally interrupted to allow coupling of the mechanical vibrations to the ossicular chain. Both electromagnetic and piezoelectric output transducers have been used to effect the mechanical vibrations upon the ossicular chain.

One example of a partial middle ear implantable (P-MEI) hearing aid system having an electromagnetic output transducer comprises: an external microphone transducing sound into electrical signals; external amplification and modulation circuitry; and an external radio frequency (RF) transmitter for transdermal RF communication of an electrical signal. An implanted receiver detects and rectifies the transmitted signal, driving an implanted coil in constant current mode. A resulting magnetic field from the implanted drive coil vibrates an implanted magnet that is permanently affixed only to the incus. Such electromagnetic output transducers have relatively high power consumption, which limits their usefulness in total middle ear implantable (T-MEI) hearing aid systems.

A piezoelectric output transducer is also capable of effecting mechanical vibrations to the ossicular chain. An example of such a device is disclosed in U.S. Pat. No. 4,729,366, issued to D. W. Schaefer on Mar. 8, 1988. In the '366 patent, a mechanical-to-electrical piezoelectric input transducer is associated with the malleus 40, transducing mechanical energy into an electrical signal, which is amplified and further processed. A resulting electrical signal is provided to an electrical-to-mechanical piezoelectric output transducer that generates a mechanical vibration coupled to an element of the ossicular chain or to the oval window 55 or round window 65. In the '366 patent, the ossicular chain is interrupted by removal of the incus. Removal of the incus prevents the mechanical vibrations delivered by the piezoelectric output transducer from mechanically feeding back to the piezoelectric input transducer.

Piezoelectric output transducers have several advantages over electromagnetic output transducers. The smaller size or volume of the piezoelectric output transducer advantageously eases implantation into the middle ear 35. The lower power consumption of the piezoelectric output transducer is particularly attractive for T-MEI hearing aid systems, which include a limited longevity implanted battery as a power source.

For implantation of hearing aid components, an access hole 85 is created in a region of the temporal bone known as the mastoid 80. An incision is made in the skin covering the mastoid 80, and an underlying access hole 85 is created through the mastoid 80 allowing external access to the middle ear 35. The access hole 85 is located approximately posterior and superior to the external auditory canal 20. By placing the access hole 85 in this region, transducers 90 and 95 can be placed on approximately the same planar level as the auditory elements 40 and 50, which they respectively engage. The electronics unit 100 of the IHA is separately implanted. This eases implantation and repair or adjustment to the electronics unit 100 of the IHA. Repairs, such as changing a battery in the electronics unit 100 of the IHA, are easily made without removing other system components.

A sensing transducer 90 is magnetically-engaged with the malleus 40 on one side of the middle ear cavity 35. On the other side of the middle ear cavity 35, a stimulating transducer 95 is magnetically-engaged with the stapes 50. The two transducers 90 and 95 are positioned within the middle ear cavity 35 by a support 120. The support 120 couples the two transducers 90 and 95 together and positions the transducers 90 and 95 within the middle ear 35 in a stable manner. For example, the support 120 is coupled to the mastoid bone 80 in one embodiment. It is preferable, but not necessary, for the support 120 to be adjustable in both the longitudinal and radial positions. The most preferred support 120 is described in co-pending U.S. patent application, entitled, "One Piece Input/Output Transducer Bracket," application Ser. No. 08/695,099, filed on Aug. 7, 1996.

A first permanent magnet 110 is affixed to each transducer 90, 95, facing the respective auditory element 40, 50 which it engages. A second permanent magnet 105 is attached to the malleus 40 (preferably the body portion) and to the stapes 50 (preferably the head portion), such that it is magnetically-repulsed, opposite from the first permanent magnet 110. The permanent magnets 105 and 110 are attached to the transducers 90 and 95, respectively, and to the auditory elements 40 and 50, respectively, by a mechanical method or a biocompatible adhesive, or any other affixing method well known to one skilled in the art. In the preferred embodiment, a biocompatible adhesive is used. Biocompatible adhesives comprise ultra-violetcured epoxies, two-part epoxies, silicone adhesives, dental adhesives, acrylic methacrylate, and urethane methacrylate.

The permanent magnet 110 on each transducer 90, 95 is situated such that its polarity acts in repulsion to the permanent magnet 105 on the adjacent auditory element 40, 50. Either negative poles of both permanent magnets 105 and 110 are situated adjacent to each other, or positive poles of both permanent magnets 105 and 110 are situated adjacent to each other.

Preferably, each transducer 90, 95 is a piezoelectric transducer, which is more efficient than electromagnetic transducers, for example. However, other types of transducers 90, 95 can be used in this invention. After the transducer support 120 and permanent magnets 105 and 110 are implanted and physiologically adapted in the middle ear 35, a constant force is applied against the auditory element 40, 50 at all times, preferably approximately 10 dynes. Thus, permanent magnets 105 and 110 need to be selected and placed within the middle ear 35 according to the desired force against the auditory element 40, 50.

Vibrations from the malleus 40 are sensed by the movement in the permanent magnet 110, which is affixed to the sensing transducer 90. The distance between the two permanent magnets, which magnetically engage the sensing transducer 90 with the malleus 40, will be approximately constant, due to the force of magnetic repulsion. Thus, movement in the second permanent magnet 105 resulting from auditory vibrations effects movement in the first permanent magnet 110 affixed to the piezoelectric transducer 90. Such movement sends a signal to the electronics unit 100 of the IHA system, where it is amplified. The amplified signal is then sent to the stimulating transducer 95, where it stimulates the stapes 50.

Figure 1B:
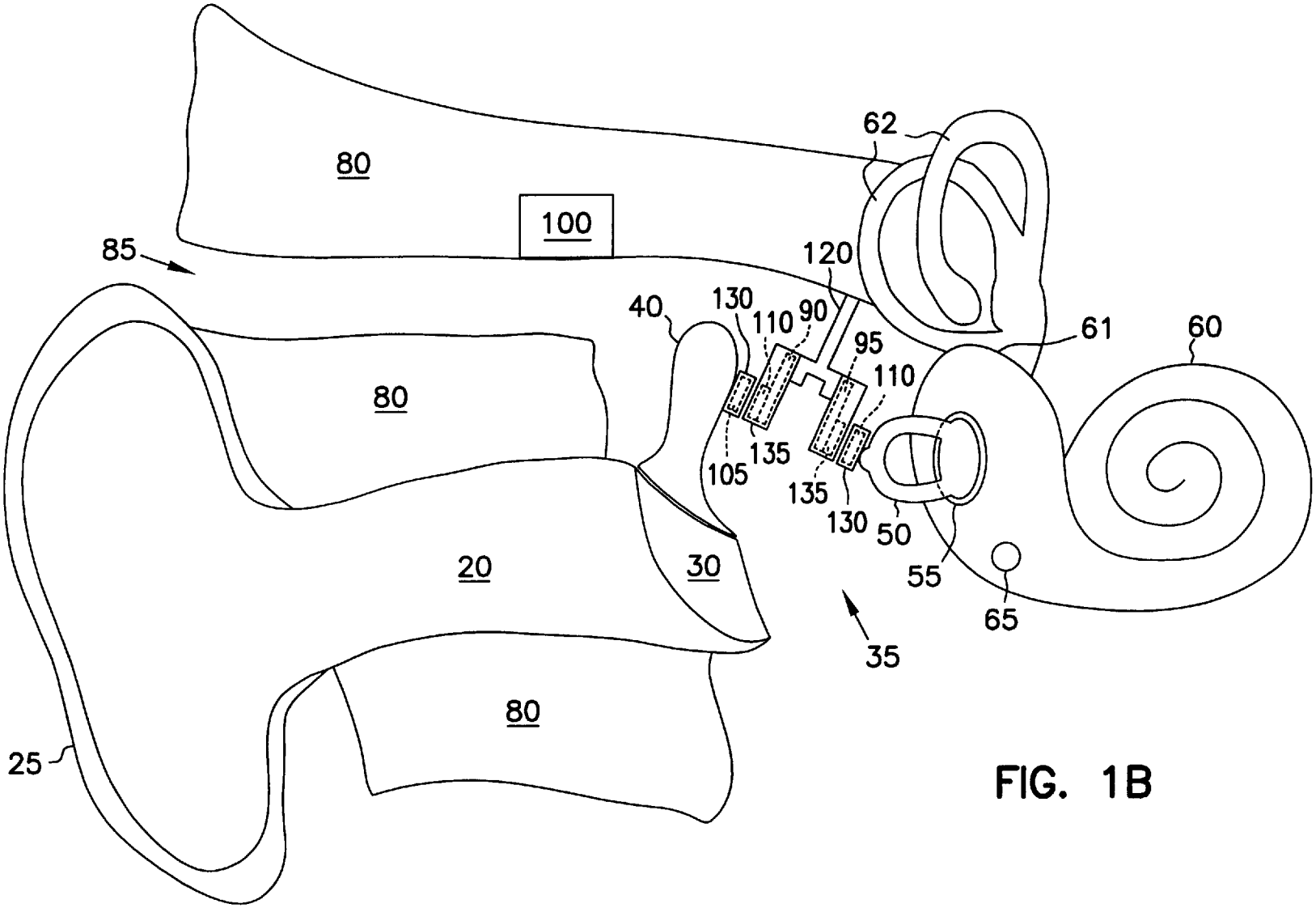
FIG. 1B is a detailed illustration of the middle ear shown in FIG. 1A, in which biocompatible cases encompass permanent magnets and transducers.

Finally, it is preferred that each of the permanent magnets 105 and 110 be encompassed in an individual biocompatible material case 130 and 135, respectively, as shown in FIG. 1B. Piezoelectric transducers are often very brittle, making surgery very difficult. By placing the transducer 90, 95 in a biocompatible case 130, 135, piezoelectric transducers are more resistant to breaking during implantation. Furthermore, acoustic feedback is decreased when using such encased transducers 90, 95. The first permanent magnet 110 and the transducer 90, 95, to which it is affixed, are encompassed in the same case 135. Examples of biocompatible materials include titanium, stainless steel, certain ceramics (ex. alumina), certain polymers (ex. polycarbonates), and other materials well known to one skilled in the art.

In all embodiments, the type of permanent magnets 105 and 110 used in this invention is not critical, as long as it provides a sufficient repulsive magnetic force to create a compressive force against the ossicular chain element 40, 50. Several different types of magnets provide such a force. For example, samarium-cobalt ($SmCo_5$) and neodymium-iron-boron (NdFeB) magnets work well. The magnets 105 and 110 should be coated with a biocompatible material prior to their placement within the middle ear 35.

In further embodiments, a flexible and/or conformable material is preformed on the contact surface of the magnet 105, which is affixed to the ossicular chain element 40, 50. A flexible material, such as low-durometer silicone, is advantageous to use because it would hold the magnet 105 in place on the ossicular chain by conforming to the shape of the ossicular chain element 40, 50, and creating friction between the material and the ossicular chain element 40, 50. A conformable material is advantageous to use because it would also conform to the shape of the ossicular chain element 40, 50, and create friction between the material and the ossicular chain element 40, 50. Certain types of material can also solidify after implantation, adding further stability to the ossicular attachment. However, the flexible and/or conformable material should always be biocompatible.

Figure 1C:
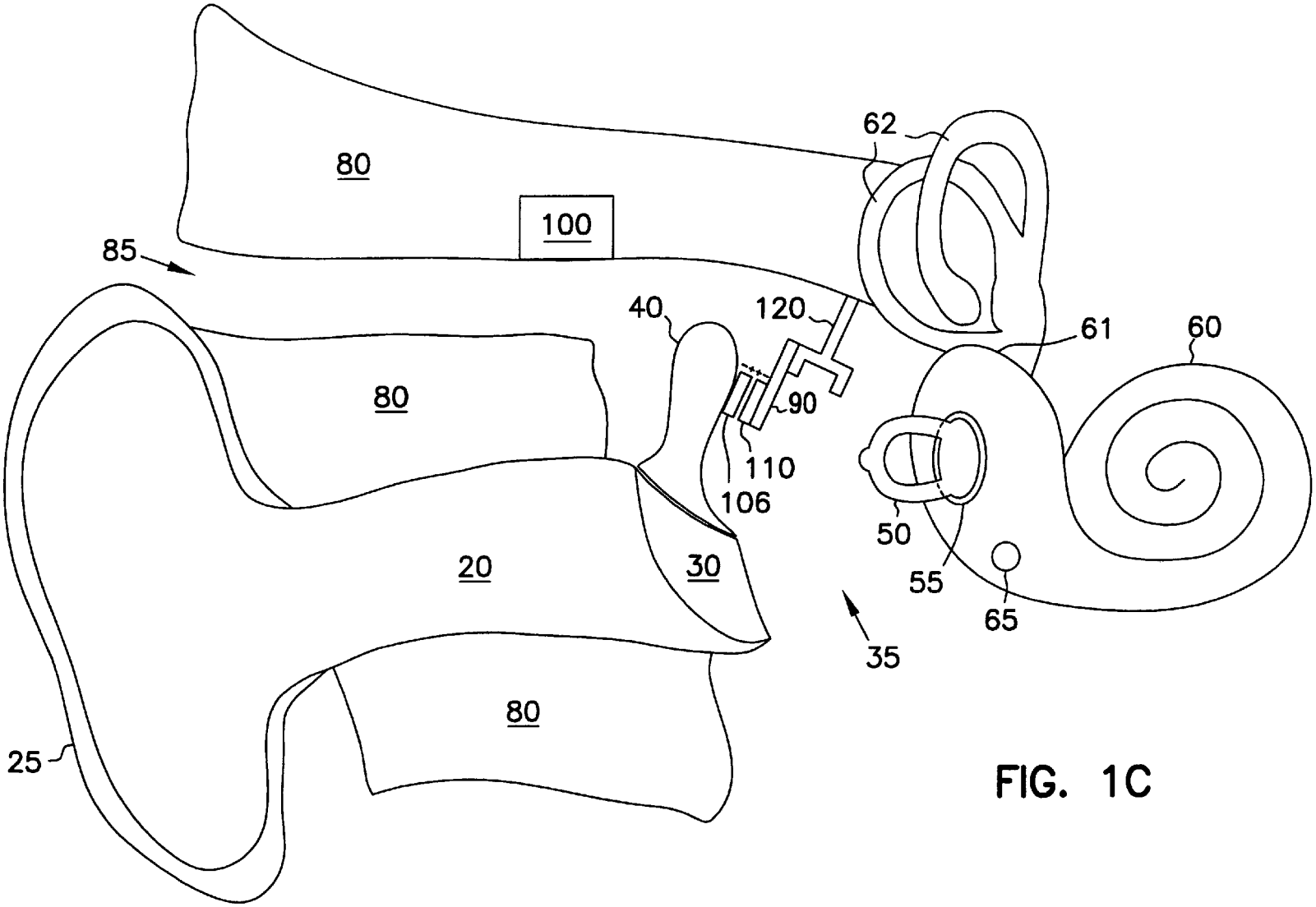
FIG. 1C is a detailed illustration of a further embodiment of the invention, in which only one of the sensing/stimulating transducers is contactless.
Figure 1D:
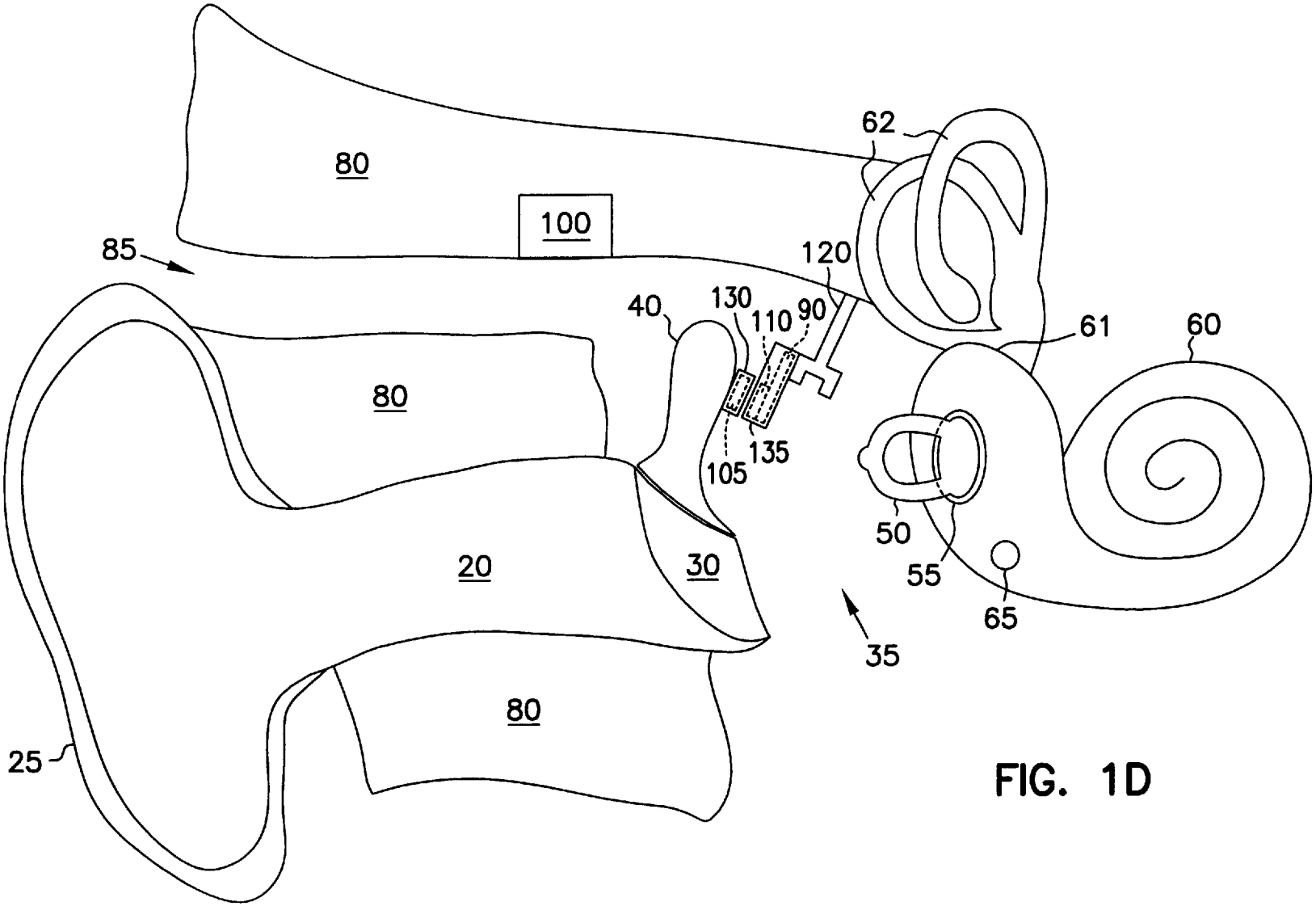
FIG. 1D is a detailed illustration of a further embodiment of the invention, in which only one of the sensing/stimulating transducers is contactless and a biocompatible case encompasses the contactless transducer and its associated magnet.

Both sensing and stimulating transducers 90 and 95, respectively, do not need to be of the contactless type described in this invention. Alternatively, as shown in FIGS. 1C and 1D, only the sensing transducer 90 engages the malleus 40. The stimulating transducer (not shown) is any conventional transducer. The contactless transducer 90 described in this invention is preferably used for a sensing transducer 90, but can be used for a stimulating transducer alone in further embodiments.

I claim:

1. A method for assisting hearing, the method comprising the steps of:

(a) affixing a first permanent magnet to a transducer;

(b) affixing a second permanent magnet to a first auditory element in a middle ear, (c) magnetically engaging the first and second permanent magnets;

(d) affixing a third permanent magnet to a second transducer;

(e) affixing a fourth permanent magnet to a second auditory element in the middle ear; and (f) magnetically engaging the third and fourth permanent magnets.

2. The method of claim 1, in which affixing the second permanent magnet to the first auditory element includes affixing the second permanent magnet to a malleus, and affixing the first permanent magnet to the first transducer comprises affixing the first permanent magnet to a sensing transducer, and affixing the fourth permanent magnet to the second auditory element includes affixing the fourth permanent magnet to a stapes, and affixing the third permanent magnet to the second transducer comprises affixing the third permanent magnet to a stimulating transducer.

3. The method of claim 1, in which at least one of the steps of affixing the first and third permanent magnets includes affixing to a piezoelectric transducer.

4. The method of claim 1, further comprising the step of encasing at least one of the first, second, third, and fourth permanent magnets in at least one biocompatible case.

5. The method of claim 1, in which magnetically engaging the third and fourth permanent magnets includes providing a force of approximately 10 dynes against the second auditory element.

6. A transducer system for an at least partially implantable hearing device, the transducer system comprising:

a first transducer;

a first permanent magnet affixed to the first transducer; and a second permanent magnet, adapted to be magnetically coupled to the first permanent magnet and also adapted to be affixed to a first auditory element in a middle ear wherein the auditory element is a malleus and said first transducer comprises a sensing transducer.

7. An at least partially implantable hearing assistance system comprising:

an electronics unit;

a first transducer, electrically coupled to the electronics unit;

a first permanent magnet affixed to the first transducer;

a second permanent magnet, adapted to be magnetically coupled to the first permanent magnet and also adapted to be affixed to a first auditory element in a middle ear;

a second transducer, electrically coupled to the electronics unit;

a third permanent magnet affixed to the second transducer; and a fourth permanent magnet, adapted to be magnetically coupled to the third permanent magnet and also adapted to be affixed to a second auditory element in the middle ear.

8. The system of claim 7, wherein the first transducer is a sensing transducer and the second transducer is a stimulating transducer.

* * * * *